US006164370A

United States Patent [19]

Robinson et al.

[11] Patent Number: 6,164,370

[45] Date of Patent: Dec. 26, 2000

[54] ENHANCED HEAT EXCHANGE TUBE

[75] Inventors: Peter W. Robinson, Branford, Conn.; Brian C. Stacks, Edwardsville, Ill.; Daniel J. Angeli, St. Louis, Mo.; Phillip J. Campbell, Rolla, Mo.; Myron R. Randlett, Cuba, Mo.; Ralph L. Webb, Port Matilda, Pa.

[73] Assignee: Olin Corporation, East Alton, Ill.

[21] Appl. No.: 09/160,029

[22] Filed: Sep. 24, 1998

Related U.S. Application Data

[63] Continuation-in-part of application No. 08/807,305, Feb. 27, 1997, abandoned, which is a continuation of application No. 08/372,483, Jan. 13, 1995, abandoned, which is a division of application No. 08/093,544, Jul. 16, 1993, Pat. No. 5,388, 329.

[60] Provisional application No. 60/066,211, Nov. 20, 1997.

[51] Int. Cl.[7] ..... F28F 1/40

[52] U.S. Cl. ..... 165/133; 165/184

[58] Field of Search ..... 165/133, 179, 165/184

[56] References Cited

U.S. PATENT DOCUMENTS

| | | | |
|---|---|---|---|
| 4,480,684 | 11/1984 | Onishi et al. | 165/133 X |
| 4,531,980 | 7/1985 | Miura et al. | 148/679 |
| 4,658,892 | 4/1987 | Shinohara et al. | 165/133 |
| 4,660,630 | 4/1987 | Cunningham et al. | 165/133 |
| 4,935,076 | 6/1990 | Yamaguchi et al. | 148/433 |
| 5,259,448 | 11/1993 | Masukawa et al. | 165/133 |
| 5,332,034 | 7/1994 | Chiang et al. | 165/184 |
| 5,791,405 | 8/1998 | Takiura et al. | 165/184 |
| 5,803,165 | 9/1998 | Shikazono et al. | 165/184 |

FOREIGN PATENT DOCUMENTS

| | | | |
|---|---|---|---|
| 518312 | 12/1992 | European Pat. Off. | 165/184 |
| 276397 | 12/1987 | Japan | 165/133 |
| 61896 | 3/1988 | Japan | 165/133 |
| 131895 | 5/1989 | Japan | 165/133 |
| 230092 | 9/1990 | Japan | 165/133 |
| 3-13796 | 1/1991 | Japan | 165/184 |
| 260792 | 9/1992 | Japan | 165/133 |
| 260793 | 9/1992 | Japan | 165/133 |
| 283398 | 10/1992 | Japan | 165/133 |
| 141890 | 6/1993 | Japan | 165/184 |
| 2212899 | 8/1989 | United Kingdom | 165/133 |

*Primary Examiner*—Leonard Leo
*Attorney, Agent, or Firm*—Wiggin & Dana; Gregory S. Rosenblatt

[57] ABSTRACT

A heat exchange tube for air conditioning and refrigeration applications is internally enhanced with helically arranged fins. The fins are separated from adjacent fins by a trough. The heat transfer coefficient is increased by forming the fins with a height-to-trough width ratio, h:T, of from 1.3:1 to 2.5:1. A further gain in heat transfer coefficient is achieved by fins having a normalized height (fin height/tube inside diameter) of at least 0.02.

11 Claims, 5 Drawing Sheets

ENHANCED HEAT EXCHANGE TUBE

CROSS-REFERENCE TO RELATED APPLICATIONS

This application claims priority to Provisional Patent Application Ser. No. 60/066,211, filed Nov. 20, 1997 the disclosure of which is incorporated by reference in its entirety herein, and is a Continuation-In-Part (CIP) of U.S. patent application Ser. No. 08/807,305 filed Feb. 27, 1997 now abandoned the disclosure of which is incorporated by reference in its entirety herein, and which is a Continuation of Ser. No. 08/372,483, filed Jan. 13, 1995, now abandoned, which is a Division of Ser. No. 08/093,544, filed Jul. 16, 1993, now U.S. Pat. No. 5,388,329.

BACKGROUND OF THE INVENTION

1. Field of the Invention

The present invention relates to an internally enhanced heat exchange tube. More particularly, an enhanced flow of heat through the tube wall is achieved by providing the inside of the tube with inwardly projecting, helically disposed, projections separated from adjacent projections by a trough.

2. Description of the Related Art

Large capacity air conditioning and refrigeration (ACR) devices utilize heat exchangers to transfer heat from one fluid to a second fluid. For evaporation cooling, warm water passes over the outside of bundles of heat exchange tubes contained within the heat exchanger while a relatively low vaporization temperature liquid refrigerant such as trichloromonofluoromethane or dichlorodifluoromethane flows through the heat exchange tubes. Heat is extracted from the water causing the refrigerant to evaporate and form vapor. The energy required for evaporation reduces the temperature of the water. External to the heat exchanger, a compressor compresses the vapor and another heat exchanger extracts heat from the vapor, condensing the vapor back to a liquid for return to the first heat exchanger.

The more efficient the transfer of heat from the water outside the heat exchange tubes to the refrigerant inside the heat exchange tubes, the more efficiently and cost effectively the ACR device may be operated.

Some heat exchange tubes have a smooth bore. However, the efficiency of the cooling apparatus is improved when the surface area of the bore is increased. One method for increasing the surface area is to texture the inside wall of the tube.

Such texturing may include projections that extend inwardly from the inner bore of the tube. Known projections include helically disposed fins as disclosed in U.S. Pat. No. 4,658,892 to Shinohara et al. and pyramid-shaped projections as disclosed in U.S. Pat. No. 5,070,937 to Mougin et al. Both the Shinohara et al. patent, including the disclosure of Reexamination Certificate ($1256^{th}$) B1 U.S. Pat. No. 4,658,892, and the Mougin et al. patent are incorporated by reference in their entireties herein.

One method of texturing the bore is to draw a smooth walled tube over a textured plug. The plug deforms the internal bore forming a plurality of parallel spiral ridges. The spiral ridges both increase the surface area and create a controlled flow of refrigerant maximizing the liquid phase contact with the tube.

The Shinohara et al. patent discloses that a number of factors influence the transfer of heat through a heat exchange tube. One factor is the height of the projections. The height may be normalized as a ratio of the projection height divided by the inside diameter of the tube.

The Shinohara et al. patent discloses that optimum heat transfer is achieved when the normalized ratio is between 0.02 to 0.03. It also discloses that apex angles less than 30° have poor workability and are not practically manufactured. The same patent suggests a fin height of 0.15–0.20 millimeters.

With a fin height ($F_H$) limited to 0.15 mm–0.20 mm, the maximum inside diameter (ID) of the tube is limited to about:

$$F_H/ID=0.02$$

$$0.2\ mm/ID=0.02$$

$$ID=10\ mm(0.39\ in.)$$

The limit on the inside diameter of the heat exchange tube is a direct result of the method of manufacture. If an alternative method of manufacture could produce higher fins without tearing or breakage, correspondingly larger inside diameter tubes could be made.

A second factor disclosed by Shinohara et al. is the ratio between the height of a projection and the cross-sectional area of a trough adjacent to the projection. The effective ratio is disclosed as between 0.15 and 0.40 mm. The reference discloses that when this ratio exceeds 0.3 mm, heat transfer abruptly begins to lower.

One alternative method to manufacture internally or externally enhanced heat exchange tubes is disclosed in U.S. Pat. No. 3,906,605 to McLain which is incorporated in its entirety by reference herein. The patent discloses texturing a metallic strip by passing the strip through textured rolls. The strip is then deformed into a generally tubular configuration bringing the edges in close proximity for welding.

SUMMARY OF THE INVENTION

Accordingly, it is an object of the invention to provide an internally enhanced heat exchange tube having an increased coefficient of heat transfer. It is a feature of the invention that this enhanced heat transfer coefficient is achieved by providing the inner bore of the heat exchange tube with a plurality of helically disposed fins. It is another feature of the invention that the ratio of the height of the fins to the inside diameter of the enhanced tube is at least 0.02 and that the ratio of the fin height to the width of a trough is between 1.3:1 and 2.5:1.

It is an advantage of the invention that when the ratio of fin height to inside diameter and the ratio of fin height-to-trough width is within the stated ranges that the coefficient of heat transfer is enhanced. A further advantage is that due to the enhanced efficiency of the heat exchange tubes of the invention, less efficient, more environmentally friendly, vaporizable liquids may be employed.

In accordance with one aspect of the invention, there is provided a heat transfer device. This heat transfer device is a metallic tube that has an inner surface and an outer surface concentrically disposed about a longitudinal axis of the metallic tube. A plurality of fins project inwardly from this inner surface and are offset from the longitudinal axis by a helix angle. These fins have a height, h, as measured perpendicular to the inner surface of the metallic tube, of at least h/I.D.=0.02, where I.D. is the inside diameter of the metallic tube as measured from the base of a trough to the base of an opposing trough. Each of the plurality of fins is separated from an adjacent fin by a trough that has a width, T, that is measured perpendicular to the helix angle (i.e., perpendicular to the long helical axis of the fin, along which the fin has a constant cross-section). The ratio of the fin height to the trough width h:T, may be between 1.3:1 and 2.5:1.

The above-stated objects, features and advantages will become more apparent from the specification and drawings that follow.

DETAILED DESCRIPTION

Figure 1:
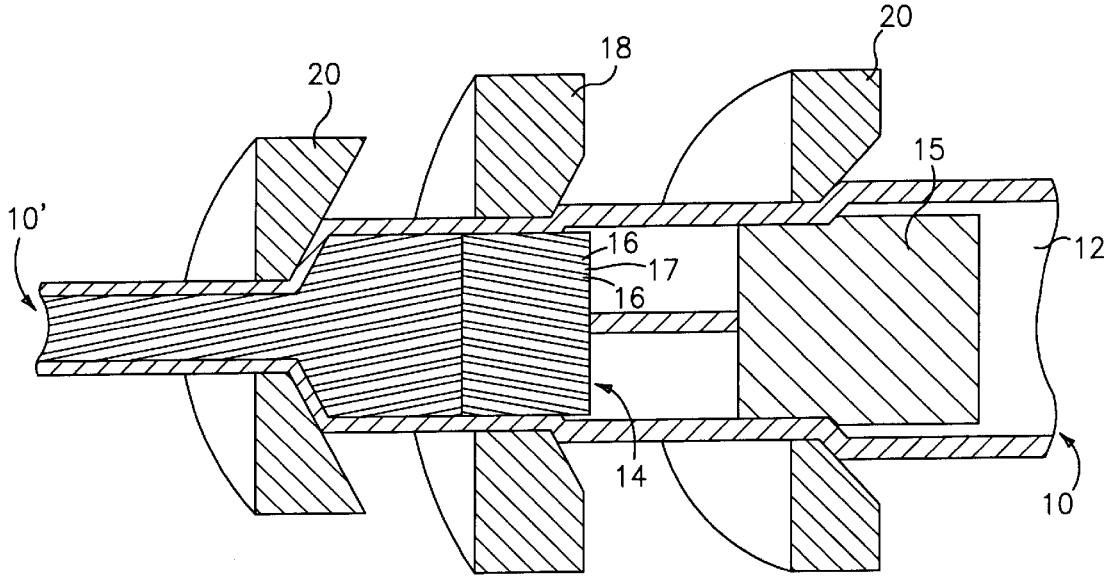
FIG. 1 (PRIOR ART)
FIG. 1 shows in cross-sectional representation a method of forming an internally enhanced tube from a smooth bore tube according to the prior art.

FIG. 1 shows in cross-sectional representation a method for forming an internally enhanced heat exchange tube according to the prior art. The tube 10 has a smooth internal bore 12 and is pulled by suitable means, such as a winch (not shown), across a grooved mandrel 14. The grooved mandrel 14 is supported and retained in place by a floating plug 15. The grooved mandrel 14 is textured with a plurality of ridges 16 separated by grooves 17. The grooved mandrel is pressed against the bore 12 by pressure applied by the working head 18. The combination of the grooved mandrel 14 and the working head 18 scores the bore 12, producing enhanced tube 10'. The tube 10' is drawn to a desired diameter by drawing dies 20.

Figure 2:
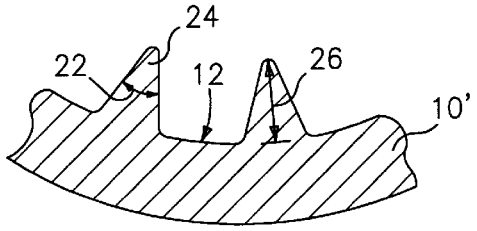
FIG. 2 (PRIOR ART)
FIG. 2 shows a typical apex angle and fin produced by the method of the prior art.

The prior art method embodied in FIG. 1 has limitations as identified in FIG. 2. The apex angle 22 (the angle of convergence of the two sides of a fin 24 viewed perpendicular to the long helical axis of the fin) is greater than about 30° to prevent tearing or deformation of the fins 24 during manufacture. Typically, the apex angle 22 is from 30° to 60°.

The height 26 of the fins 24 is limited by the strength of the material comprising the heat exchange tube 10'. To avoid tearing or deformation of the fins, in a copper or copper based alloy, the typical fin height 26 is less than 0.20 millimeters.

Figure 3:
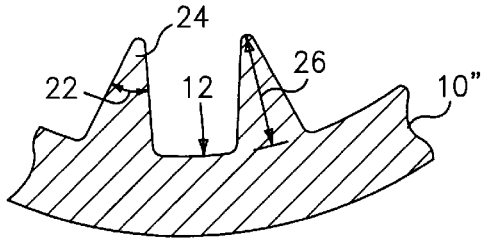
FIG. 3 shows in cross-sectional representation the reduced apex angle and increased fin height of the present invention.

By the use of the roll forming technique described below, a first embodiment of an improved heat exchange tube 10" as illustrated in magnified cross-sectional representation in FIG. 3 is produced. The smaller the apex angle, the higher the fin density. Increasing the fin density results in a higher tube bore surface area for increased thermal transport. The apex angle 22 of the fin 24 of the tube 10" is less than about 40°. More preferably, the apex angle is from about 15° to about 28° and most preferably, from about 20° to about 25°.

The fin height 26 is in excess of about 0.25 millimeters and typically from about 0.30 to about 0.50 millimeters and more narrowly for certain applications, from about 0.32 to 0.38 millimeters. This will advantageously be at least 2% and typically no more than 10% of the tube inner diameter. The enhanced heat exchange tube 10" is improved either by reducing the apex angle 22, increasing the fin height 26, or both according to the invention. Either improvement increases the surface area of the tube bore improving the on efficiency of heat conduction from an internal refrigerant to the tube 10".

Figure 4:
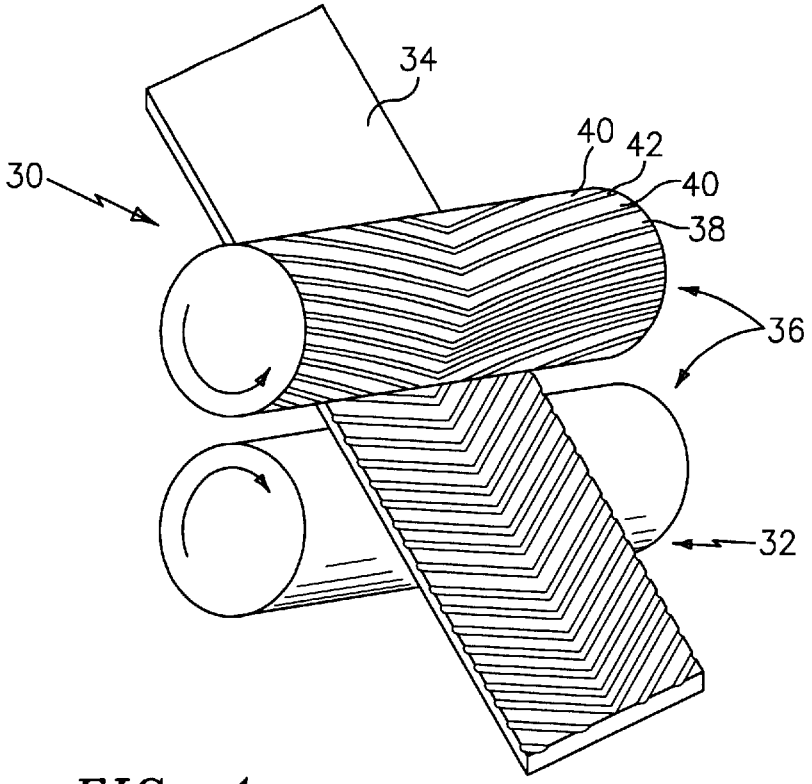
FIG. 4 illustrates a method to texture the surface of a metallic strip in accordance with the invention.

The method of manufacture is illustrated in isometric view in FIG. 4. FIG. 4 shows an apparatus 30 for impressing a textured pattern 32 on at least one side of a metallic strip 34. To maximize thermal conductivity, the metallic strip is preferably copper or a copper based alloy. A set of rolls 36 powered by a rolling mill (not shown) deforms a least one surface 32 of the strip 34. A roll 38 contacting side of the strip which will form the inside surface of the welded tube is provided with a desired pattern. The roll 38 is machined to have a plurality of grooves 40 uniformly spaced around the circumference. The grooves may form any desired surface pattern. A chevron (a.k.a. a double helical pattern) centered about the middle of the long axis of the roll is preferred. The chevron facilitates uniform metal flow through the rolls.

A less preferred shape is grooves extending straight across the roll. With straight grooves, it is difficult to obtain sufficient metal flow without breaking the strip. A single helical pattern wherein the fins are arranged as a plurality of parallel helices provides a large thrust, pushing the strip angularly from the rolls and is also less preferred.

Figure 5:
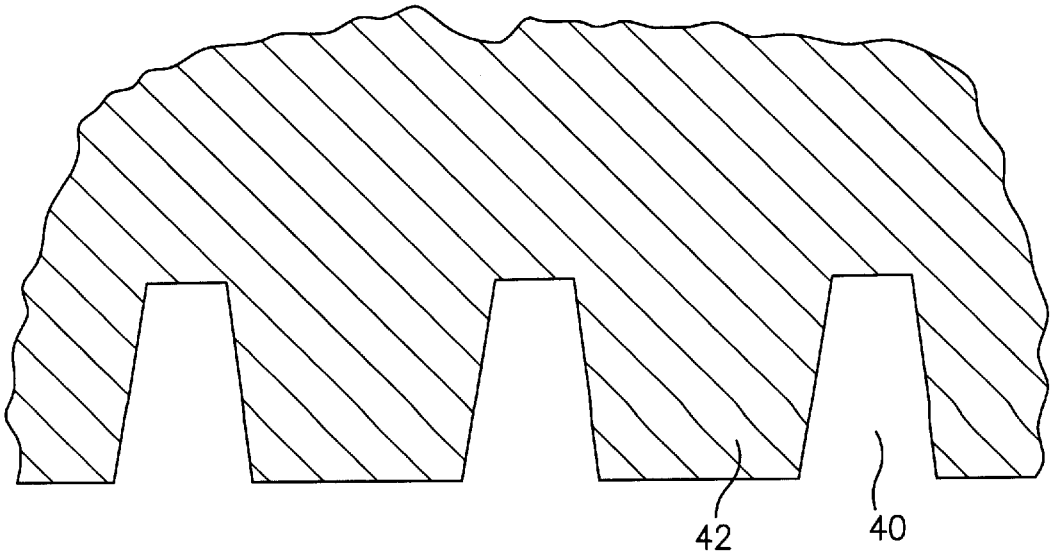
FIG. 5 is a magnified cross-sectional view of a portion of a roll used to impress a texture into the surface of the strip.

Separating the grooves 40 of the roll 38 are roll teeth 42. As shown in magnified cross sectional representation in FIG. 5, the roll teeth 42 which form the grooves in the metallic strip are tapered. The exterior ends of the roll teeth are slightly smaller than the base of the roll teeth. The taper is small, but an angle is necessary so that the roll teeth pierce the metallic strip and separate from the strip without breaking. The roll tooth angle is half the desired apex angle. For the tube 10", preferably, the roll tooth angle would be from about 7.5° to about 14° and more preferably, from about 10° to about 12.5°.

The metallic strip deformed by the roll teeth 42 flows into the grooves 40 forming enhancement fins. The amount of metal which can be moved is a factor of the temper and composition of the metallic strip, as well as the deforming means. The separating force of the rolling mill should be sufficient to move from about 30% to about 60% of the deformed metal into the fin area. Preferably, from about 35% to about 50% of the deformed metal is moved into the fin area. In the process of forming the fins, as the separating force applied by the rolling mill increases, the metal goes from an elongation mode to a fin forming mode. This transition point is characterized by an increase in overall gage. The effective separating force is from this transition point and higher.

The portion of the metallic strip deformed by the rolling mill either contributes to the fins or to an increase in the length of the strip. It is desirable to maximize the fin formation and to minimize increase in length. To increase fin height, the friction between the rolls and the strip is reduced. Exemplary ways to reduce friction include polishing or plating the rolls to a smooth finish. One exemplary plating is a chromium flash. Lubrication is another preferred method of reducing friction. A minimal effective amount of lubricant is used to prevent organic contamination of the weld seam and to prevent adherence of the base metal to the roll. To maximize effectiveness, the lubricant is applied as a mist directly to the rolls of the rolling mills. Applying the lubricant to the metallic strip is less preferred. During deformation, a lubricant film on the strip is sheared and the beneficial effect lost. One preferred lubricant is polyethylene glycol.

The metallic strip should be fully annealed, but have sufficiently inhibited recrystallization grain growth to prevent necking. Generally, the crystalline grain size should be a maximum of 0.050 millimeters and preferably, the average grain size should be from about 0.015 to about 0.030 millimeters.

Figure 6:
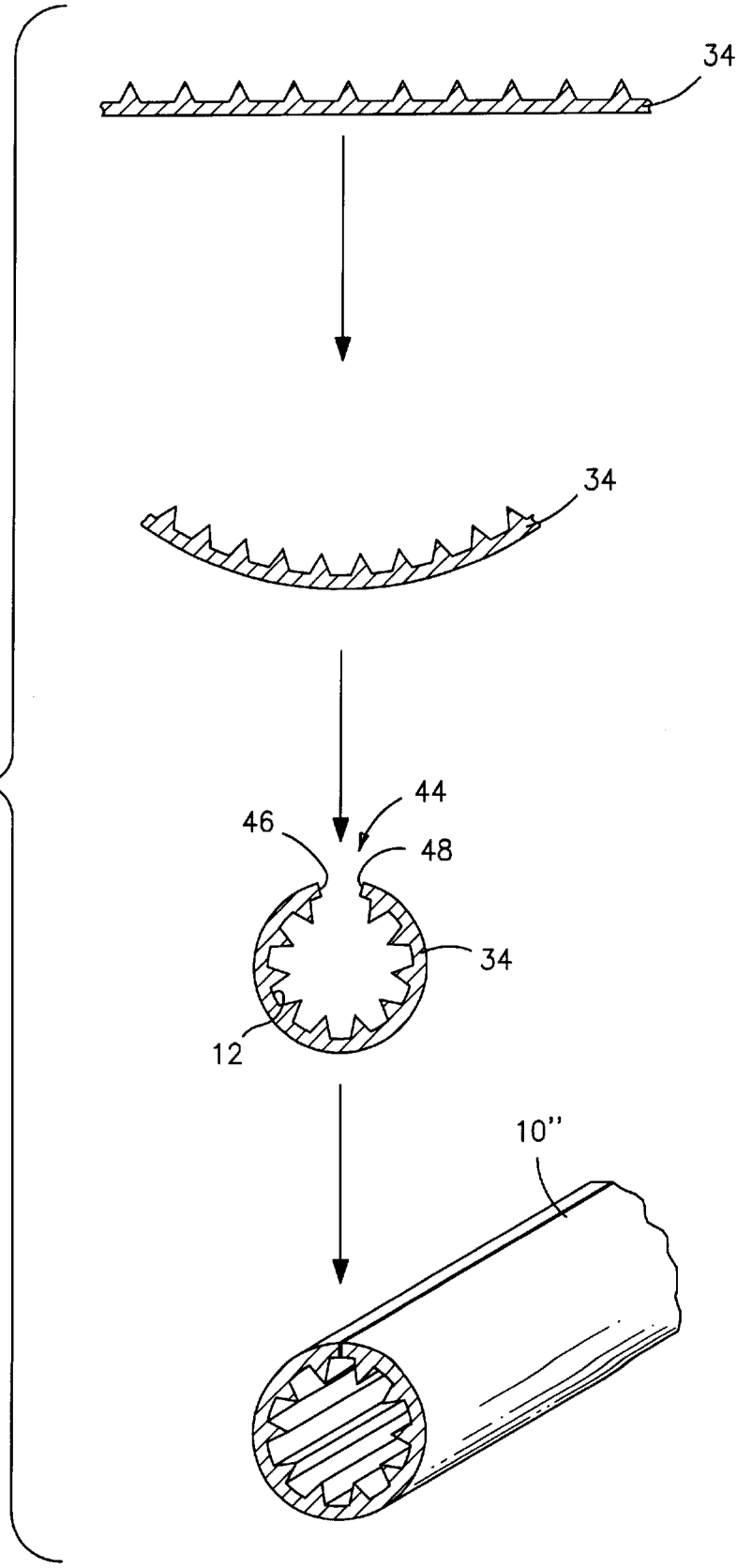
FIG. 6 shows the sequence of forming steps to convert the textured metallic strip into an enhanced welded tube.

The textured strip is then formed into a tube as illustrated in FIG. 6. The metallic strip 34 is deformed into a generally circular configuration 44, such as by passing through a series of forming rolls. The enhanced bore side 12 of the metallic strip 34 forms the internal bore of the circular structure 44.

The opposing edges 46, 48 of the metallic strip 34 are brought in close proximity and bonded together forming the enhanced tube 10". A preferred bonding method is welding such as by a TIG torch or induction welding.

While the invention is directed to the manufacture of internally enhanced heat exchange tubes, the process is useful for other heat exchange surfaces requiring a plurality of closely spaced fins, for example, planar heat exchange surfaces.

Figure 7:
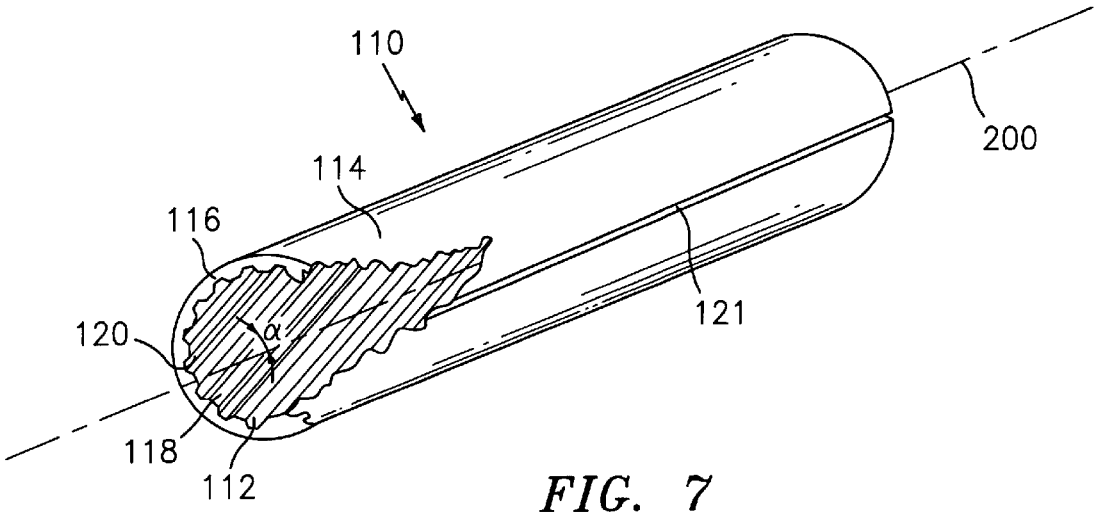
FIG. 7 illustrates in partial breakaway view a heat exchange tube in accordance with the invention.

FIG. 7 illustrates in partial breakaway view a second embodiment of heat exchange tube 110 used in an ACR device for evaporative cooling. The heat exchange tube 110 is metallic and formed from a suitable metal or metal alloy, such as a copper alloy, an aluminum alloy or an iron based alloy like stainless steel. The heat exchange tube 110 has an inner surface 112 and an outer surface 114. The inner surface 112 and outer surface 114 are disposed substantially concentrically about a longitudinal axis 200 of the tube 110.

The heat exchange tube 110 has an outside diameter (O.D.) and an inside diameter (I.D.). The I.D. is measured from the base of a first trough to the base of a second trough diametrically opposed to the first trough. An exemplary O.D. is 0.625 inch (⅝ inch) and an exemplary I.D. is 0.57–0.60 inch.

A plurality of heat exchange tubes 110 are formed into a tube bundle by joining, such as by brazing or mechanical joining, the ends of the tubes to header plates. The tube bundles are then inserted into the heat exchange unit of an ACR device. Water, or another high heat capacity liquid, is circulated through the cooling unit and contacts the outer surfaces 114 of the heat exchange tubes 110. The water is traveling in a direction that is typically perpendicular to the longitudinal axis, but may be at some other angle or parallel to the longitudinal axis. A low vaporization temperature liquid flows through the heat transfer tubes 110, generally in the direction of the longitudinal axis. Fins 118 project inwardly from tube body 116 beyond the inner surface 112. The fins 118 are offset relative to the longitudinal axis 16 by a helix angle, $\alpha$, as measured from the root of a fin. Troughs 120 separate each of the fins 118 from adjacent fins. The fins may be rolled into a metal strip which is then formed into a tube. In such a case, the tube may include a longitudinal welded seam 21 which may constitute an interruption in the helical pattern of the fins and troughs. The fins may be in a chevron pattern or arranged as a plurality of parallel helices such as may be obtained by splitting a chevroned strip longitudinally along the chevron vertices and forming each of the two resulting pieces into a tube.

When the low vaporization temperature liquid flows through heat exchange tube 110, a portion of the liquid flows in troughs 120, imparting the liquid with an angular motion. This angular motion increases the contact time of the fluid with the inner surfaces 112 of the heat exchange tube 110 and, in cooperation with the increased surface area due to the fins 118, increases the heat transfer coefficient of the heat exchange tube 110. Increasing the heat transfer coefficient increases the amount of heat transferred from the water on the outside of the tube to the low vaporization temperature liquid on the inside of the tube.

Figure 8:
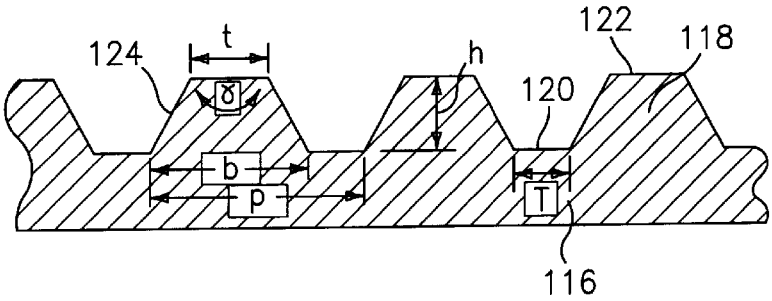
FIG. 8 illustrates in cross-sectional representation the internal enhancement of the heat exchange tube of FIG. 1.

FIG. 8 illustrates in cross-sectional representation the relationship between the fins 118 and troughs 120 as viewed perpendicular to the long helical axes of the fins. The fins 118 have a height, h, measured from the base of a trough 120 to a top flat 122 of a fin 118. The fins 118 have a base, b, with a length that extends from the end of one trough 120 to the beginning of the next trough 120. The side walls 124 of the fins 118 come together at an apex angle, $\gamma$, and are truncated at the height, h, such that the fin terminates at a top flat 122 of length, t. The troughs have a width, T, and the sum b+T is the pitch, P.

The heat transfer coefficient of the inside surface of the tube, the rate that heat is transferred to the liquid on the inside of the heat exchange tube from the tube wall is dependent on a number of geometrical and material features of the heat exchange tube. The coefficient is also dependent on the liquid's properties including its superheat temperature. The superheat temperature is the temperature by which the temperature of the vapor exiting the heat exchange tube exceeds the equilibrium boiling point of the low vaporization temperature liquid contained within the tube.

The advantages of the invention will become more apparent from the examples that follow.

EXAMPLES

Testing was performed on twelve different heat exchange tubes having internal enhancements with the geometries specified in Table 1. The outer surfaces of the tubes were not enhanced. Each of the tubes had a nominal outside diameter of 0.625 inch and a nominal inside diameter, measured from the base of a trough to the base of a diametrically opposed trough of 0.585 inch. Tubes 1–7, 11 and 12 are experimental, tube 8 is a tube having an S/h ratio under 0.3 mm as suggested by Shinohara et al. Tubes 9 and 10 are commercially available.

TABLE 1

| Tube | Height (in) | Pitch (in) | Trough (in) | Base (in) | Top Flat(in) | Helix (deg.) | Apex (deg.) | S/h (mm) | h/T | Area Ratio |
|---|---|---|---|---|---|---|---|---|---|---|
| 1 | 0.0139 | 0.0223 | 0.0119 | 0.0104 | 0.0038 | 20.5 | 26.8 | 0.386 | 1.168 | 1.985 |
| 2 | 0.0144 | 0.0245 | 0.0109 | 0.0136 | 0.0041 | 22.3 | 36.5 | 0.397 | 1.321 | 1.850 |
| 3 | 0.0123 | 0.0248 | 0.0133 | 0.0115 | 0.0029 | 18.3 | 38.5 | 0.447 | 0.925 | 1.704 |
| 4 | 0.0172 | 0.0309 | 0.0143 | 0.0166 | 0.0049 | 21.3 | 37.6 | 0.512 | 1.203 | 1.797 |
| 5 | 0.0194 | 0.0317 | 0.0146 | 0.0171 | 0.0029 | 18.2 | 40.0 | 0.550 | 1.329 | 1.857 |
| 6 | 0.0190 | 0.0267 | 0.0108 | 0.0159 | 0.0030 | 21.0 | 37.6 | 0.439 | 1.759 | 2.019 |
| 7 | 0.0140 | 0.0216 | 0.0106 | 0.0110 | 0.0040 | 12.9 | 28.2 | 0.359 | 1.321 | 2.011 |
| 8 | 0.0096 | 0.0190 | 0.0063 | 0.0126 | 0.0030 | 19.5 | 53.8 | 0.284 | 1.524 | 1.620 |
| 9 | 0.0134 | 0.0233 | 0.0108 | 0.0126 | 0.0024 | 21.5 | 42.0 | 0.405 | 1.241 | 1.791 |
| 10 | 0.0133 | 0.0234 | 0.0107 | 0.0127 | 0.0031 | 22.7 | 39.0 | 0.391 | 1.243 | 1.803 |
| 11 | 0.0188 | 0.0253 | 0.0108 | 0.0145 | 0.0033 | 22.0 | 33.2 | 0.417 | 1.741 | 2.108 |
| 12 | 0.0192 | 0.0317 | 0.0133 | 0.0184 | 0.0032 | 20.3 | 43.3 | 0.531 | 1.444 | 1.822 |
| 13 | 0.0167 | 0.0265 | 0.0100 | 0.0165 | 0.0042 | 22.7 | 40.4 | 0.410 | 1.670 | 1.879 |

The tubes were installed in a commercial chiller barrel designed to chill water flowing in cross flow on the outside of the tubes by evaporating with refrigerant R22 (chlorodifluoromethane, $CHClF_2$) flowing inside the tubes. The heat load in all tests was nominally 25 Tons (for refrigeration, 1 Ton is equivalent to 12000 BTU/hour) and the water temperatures were adjusted to achieve this with nominal exit refrigerant superheats of 4, 8 and 12° F. The heat transfer coefficient for the inside tube surface was calculated using standard data reduction techniques and is based on the surface area of an unenhanced (smoothbore) tube of the inside diameter. For reference, the final column of Table 1 identifies an area ratio which is a ratio of the actual surface area of the subject tube relative to the surface area of the reference unenhanced tube. The penultimate column identifies the Shinohara et al. ratio of trough cross-sectional area S to fin height h. The heat transfer coefficient of the outside surface was known from a previous Wilson plot of the bundle. The pressure drop across the chiller barrel on the refrigerant side was measured using a differential pressure transducer.

Table 2 shows the results of these tests.

TABLE 2

| | Heat Transfer Coefficient (BTU/ft$^2$hr ° F.) | | | Pressure Drop (psi) | | | Heat Transfer Coefficient (Normalized)(BTU/ft$^2$hr ° F.) | | |
|---|---|---|---|---|---|---|---|---|---|
| Tube | 4° F. | 8° F. | 12° F. | 4° F. | 8° F. | 12° F. | 4° F. | 8° F. | 12° F. |
| 1 | 1557.7 | 1337.4 | 908.9 | 2.60 | 2.66 | 2.93 | 784.9 | 673.9 | 458.0 |
| 2 | 1977.4 | 1554.0 | 993.8 | 2.35 | 2.50 | 2.77 | 1068.8 | 839.9 | 537.2 |
| 3 | 1352.3 | 1255.5 | 928.5 | 2.43 | 2.51 | 2.63 | 793.4 | 736.7 | 544.8 |
| 4 | 1571.4 | 1413.5 | 1000.5 | 2.88 | 2.91 | 3.12 | 874.42 | 786.6 | 556.7 |
| 5 | 2089.2 | 1716.5 | 1035.7 | 3.07 | 3.05 | 3.34 | 1125.0 | 924.3 | 557.7 |
| 6 | 2644.1 | 1772.8 | 1078.0 | 2.73 | 2.70 | 3.10 | 1309.6 | 878.1 | 533.9 |
| 6A | 2800.1 | 2152.7 | 1115.0 | 3.5O | 3.57 | 3.80 | 1386.9 | 1066 | 552.3 |
| 7 | 1003.3 | 910.9 | 753.0 | 2.31 | 2.37 | 2.5O | 498.9 | 453.0 | 374.5 |
| 8 | 1611.1 | 1203.3 | 793.3 | 2.55 | 2.68 | 2.92 | 994.2 | 742.6 | 489.6 |
| 9 | 1858.3 | 1527.7 | 988.5 | 2.84 | 3.01 | 3.39 | 1037.8 | 853.2 | 552.1 |
| 10 | 1951.9 | 1519.4 | 987.6 | 2.62 | 2.71 | 2.84 | 1082.4 | 842.5 | 547.6 |
| 11 | 1828.1 | 1652.3 | 1026.2 | 3.64 | 3.64 | 3.91 | 867.3 | 783.9 | 486.9 |
| 11A | 1969.1 | 1687.3 | | 3.57 | 3.68 | | 934.2 | 800.5 | |
| 12 | 1958.0 | 1700.3 | 1035.4 | 3.49 | 3.57 | 3.80 | 1074.3 | 933.0 | 568.2 |
| 13 | 1973.3 | 1664.8 | 999.0 | 3.72 | 3.86 | 4.07 | 1050.1 | 885.9 | 531.6 |

Specifically, for superheats of 4, 8, and 12° F. Table 2 shows at columns 2–4 the heat transfer coefficient (also plotted in FIG. 9); at columns 5–7 the pressure drop; and at columns 8–10 the heat transfer coefficient normalized by dividing the entry of columns 2–4 by the area ratio for the particular tube. Given the difficulty in attempting to maintain the tubes at the exact 4, 8, and 12° F. superheats, for each tube, readings were taken at superheats close to each of the three target temperatures for such tube. A linear approximation of heat transfer coefficient to superheat temperature was made based upon the three readings. This approximation was then used to generate the indicated heat transfer coefficients at the exact target superheats. The tubes identified as 6A and 11A, respectively, while sharing the geometries of tubes 6 and 11, were tested as part of a different test series than tubes 6 and 11. Results of these tests have been included for completeness. Tube 11A was tested only at superheats near 4 and 8° F.

Observation of the data appears to indicate a number of phenomena. As to helix angle, a comparison of the data for tube 7 with other tubes such as tube 1 tends to indicate that a low helix angle (12.9° with tube 7) negatively impacts heat transfer. Although it is believed that a helix angle range of between about 10° and 30° may provide an advantageous heat transfer coefficient, a more preferred range is from about 15° to about 25° and a most preferred range from about 17° to about 23°.

Figure 9:
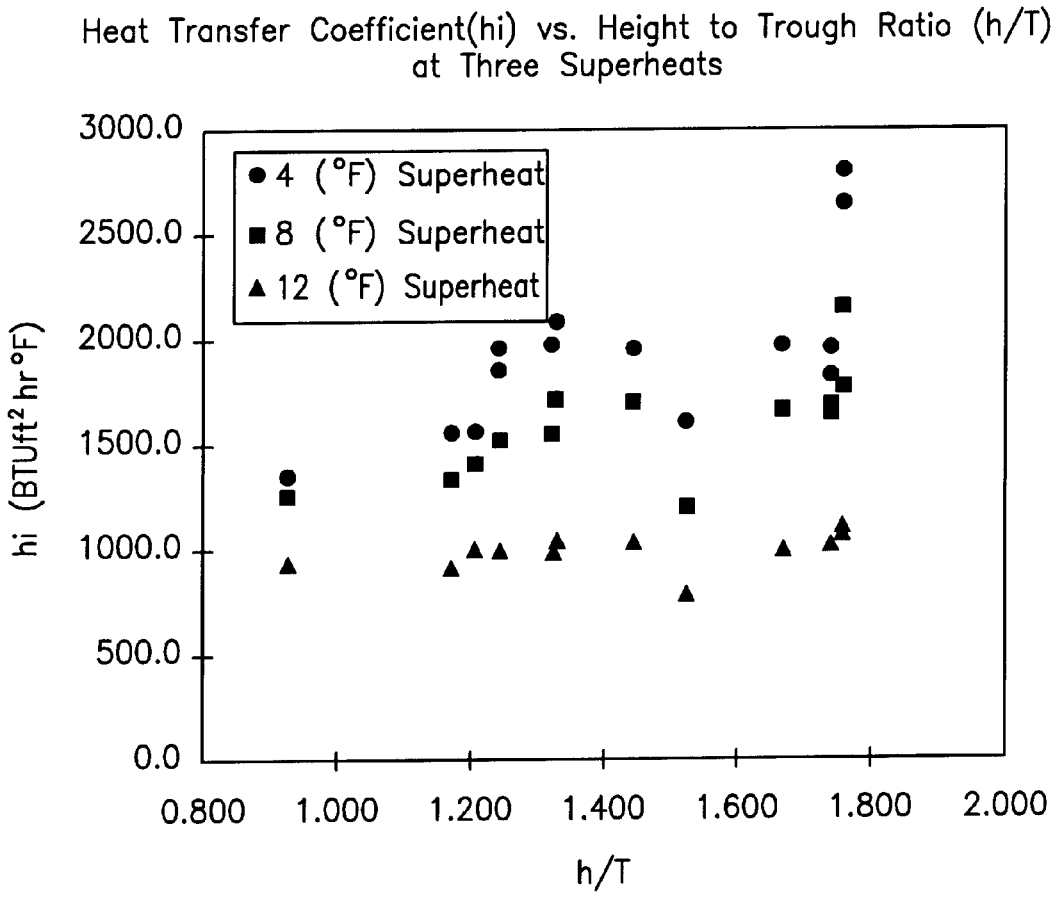
FIG. 9 is a plot of heat transfer coefficient vs. fin height-to-trough ratio for various tubes.

As shown in FIG. 9, the data evidences a general trend toward higher heat transfer coefficients at higher height-to-trough ratios. The significance of such increase appears to be higher at relatively low superheats than at relatively high superheats.

Tube 5 had heat transfer performance up to 13% higher than commercially available tubes 9 and 10. This tube had a 0.0194 inch high fin with a 0.0029 inch top flat and a height-to-trough ratio of 1.33. The base width, defined by the 40° apex angle, was 0.0171 inch.

Tube numbers 6 and 6A had a height and top flat dimension similar to tube number 5, but a higher height-to-trough ratio and had measured performance of about 42% and 51% better than commercially available tube numbers 9 and 10. The base width defined by the 38° apex angle was 0.0159 inch. In the test of tube number 6, the pressure drop in this tube was intermediate those of the two commercial tubes 9 and 10. The relatively high heat transfer of tube numbers 6 and 6A appears particularly significant at lower superheats.

Heat exchange tubes with the highest fin height possible combined with the smallest top flat possible and a height-to-trough ratio in the range of 1.3:1 to 2:1 or even to 2.5:1 are expected to give the greatest heat transfer coefficient over the range of apex angles from about 27° to about 55°. A preferred apex angle is from about 30° to about 45° and a most preferred apex angle is from about 34° to about 44°.

Alternatively, the heat transfer coefficient may be increased by increasing the fin height. Since higher fin heights are more difficult to manufacture, it is believed that a useful range for fin heights is from about 0.015 inch to about 0.03 inch. A range for the top flats would be from about 0.002 inch to about 0.005 inch, with a range of from about 0.0025 inch to about 0.0035 being preferred.

Further indications of the heat transfer efficiencies of tube numbers 5 and 6 are shown when the heat transfer coefficient is normalized by dividing the heat transfer coefficient by the surface area ratio (ratio of the surface area of the subject tube divided by that of a smoothbore tube). Were the heat transfer coefficients of the various tubes merely proportional to their surface areas, then the normalized heat transfer coefficients would all be the same. Where the normalized transfer coefficients differ, it is evidence of a higher heat transfer per surface area (heat flux), indicating that a more efficient heat transfer may be taking place. Even so normalized, tubes 5 and 6 appear to exhibit relatively high heat transfer.

The last two columns of Table 2 illustrate that the fin height-to-trough ratio more significantly affects the heat transfer coefficient than the trough area to height ratio. The effect of the trough (S) area to height (h) ratio, expressed in millimeters, was disclosed by Shinohara et al. To obtain a large heat transfer coefficient, it is believed that the ratio of the fin height to the trough width be at least 1.3:1. Preferably, h:T is from 1.3:1 to 2.5:1 and, more preferably, from about 1.3:1 to about 1.8:1.

While increasing the fin height has been known to cause a pressure drop in the low vaporization temperature liquid, it appears that the pressure drop may be affected by the base width of the fins, as well as the apex angle $\gamma$ since $\gamma$ defines the base width if the height and the top flat of the fins are given. The advantages in increased heat transfer coefficient achieved by increasing the fin height appear to outweigh the loss due to pressure drop such that, particularly at a 4° F. superheat, increasing the fin height dramatically increases the performance of the bundle or heat exchanger.

It is apparent that there has been provided in accordance with the invention an internally enhanced heat exchange tube that fully satisfies the objects, means and advantages set forth hereinbefore. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A metallic heat exchange tube, comprising:

tubular body having an inner surface and an outer surface concentrically disposed about a longitudinal axis thereof;

a plurality of fins projecting inwardly from said inner surface and offset from said longitudinal axis by a helix angle, said fins having a height, h, as measured perpendicular to said inner surface such that h/I.D. is at least 0.02, where I.D. is the inside diameter of the metallic tube and I.D. is from 0.57 inch to 0.60 inch, each of said plurality of fins being separated from an adjacent fin by a trough having a width, T, as measured perpendicular to adjacent fins, wherein a ratio of h:T is from 1.3:1 to 2.5:1; and a longitudinal welded seam.

2. The heat exchange tube of claim 1 wherein h:T is from 1.3:1 to 1.8:1.

3. The heat exchange tube of claim 1 wherein each of said plurality of fins have an apex angle of less than 40°.

4. The heat exchange tube of claim 1 wherein h is from 0.017 inch to 0.021 inch and T is from 0.009 inch to 0.016 inch.

5. The heat exchange tube of claim 1 wherein the helix angle is between about 15° and about 30°.

6. The heat exchange tube of claim 1 wherein the helix angle is between about 17° and about 23°.

7. The heat exchange tube of claim 6 wherein h:T is from 1.7:1 to 1.8:1.

8. A metallic heat exchange tube comprising the unitarily formed combination of:

a tubular body having an inner surface having an inner diameter and a outer surface having an outer diameter concentrically disposed about a longitudinal axis;

a plurality of fins projecting inward from said inner surface, the fins having:

a helix angle of between 15° and 25°; and a fin height which is in excess of 0.017 inch (0.043 cm) and is at least 2% of the inner diameter, each of said plurality of fins being separated from an adjacent such fin by a trough having a trough width, as measured perpendicular to the adjacent fins wherein the fin height is between 130% and 250% of the trough width.

9. The tube of claim 8 wherein the tubular body is formed from a strip into which the plurality of fins have been rolled and wherein the tube further comprises a longitudinal weld seam.

10. The tube of claim 9 wherein the inner diameter is less than about 0.60 inch (1.52 cm) and wherein the fin height is no more than 10% of the inner diameter.

11. A welded heat exchange tube having a tubularly shaped welded metallic strip with a longitudinal weld bead and an internal bore enhanced by a plurality of fins, said plurality of fins having a fin height of at least 0.38 millimeter and at most about 0.5 millimeter and forming an apex angle of less than about 40°, said plurality of fins being separated by grooves uniformly spaced between the plurality of fins, a ratio of said fin height to an inner diameter at said grooves being at least 0.02, the fins being helically arranged with a helix angle of between about 17 degrees and about 23 degrees and having a groove width measured perpendicular to said helix angle such that a ratio of the fin height to the groove width is from 1.3:1 to 2.5:1.

* * * * *